US006593517B2

(12) United States Patent
Chen

(10) Patent No.: US 6,593,517 B2
(45) Date of Patent: Jul. 15, 2003

(54) DRUM

(76) Inventor: Chun-Cheng Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/024,603

(22) Filed: Dec. 17, 2001

(65) Prior Publication Data

US 2003/0110922 A1 Jun. 19, 2003

(51) Int. Cl.[7] ..... G10D 13/08
(52) U.S. Cl. ..... 84/411
(58) Field of Search ..... 84/411 R, 413, 84/411 A

(56) References Cited

U.S. PATENT DOCUMENTS 887,016 A * 5/1908 Poland ..... 84/411 R
1,590,754 A * 6/1926 Hulbert ..... 29/509
6,362,408 B1 * 3/2002 Chang ..... 84/411 R

* cited by examiner

*Primary Examiner*—Shih-Yung Hsieh

(57) ABSTRACT

A drum has a shell, a pair of batter heads disposed on two sides of the shell, a pair of collars enclosing the batter heads and surrounding the shell, a pair of positioning hoops surrounding the collars, a large number of connection seats disposed on the shell, a large number of positioning mounts disposed on the positioning hoops, and a large number of positioning fasteners fastening the connection seats and the positioning mounts together. Each of the positioning hoops has an inner curved flange to press the corresponding collar on the shell.

1 Claim, 3 Drawing Sheets

DRUM

BACKGROUND OF THE INVENTION

The present invention relates to a drum. More particularly, the present invention relates to a drum which has a positioning hoop having an inner curved flange.

Referring to FIGS. 1 and 1A, a conventional drum comprises a shell 10', a pair of batter heads 12' disposed on two sides of the shell 10', a pair of collars 11' enclosing the batter heads 12' and surrounding the shell 10', a pair of positioning rings 13' surrounding the collars 11', a large number of connection seats 20' disposed on the shell 10', a large number of positioning mounts 21' disposed on the positioning rings 13', and a large number of bolts 14' fastening the connection seats 20' and the positioning mounts 21' together. The relative positions of the shell 10' and the corresponding collar 11' should be adjusted manually. If a user does not watch the relative positions of the shell 10' and the corresponding collar 11' precisely while adjusting, the period of usage of the drum will be shortened because of the deviation of the relative positions. If the positioning ring 13' does not surround the corresponding collar 11' evenly, the batter head 12' cannot be tightened.

SUMMARY OF THE INVENTION

An object of the present invention is to provide a drum which has a positioning hoop having an inner curved flange in order to press a collar on a shell.

Accordingly, a drum comprises a shell, a pair of batter heads disposed on two sides of the shell, a pair of collars enclosing the batter heads and surrounding the shell, a pair of positioning hoops surrounding the collars, a large number of connection seats disposed on the shell, a large number of positioning mounts disposed on the positioning hoops, and a large number of positioning fasteners fastening the connection seats and the positioning mounts together. Each of the positioning hoops has an inner curved flange to press the corresponding collar on the shell.

DETAILED DESCRIPTION OF THE INVENTION

Figure 1:
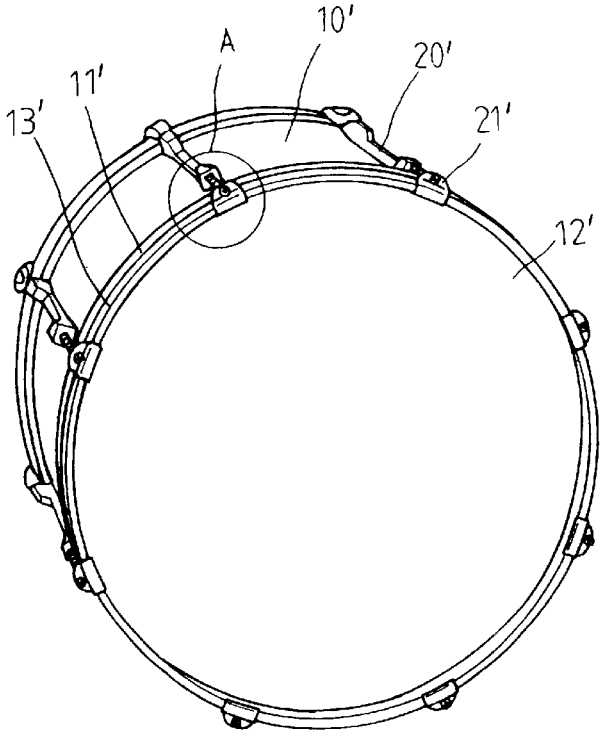
F I G. 1 PRIOR ART
FIG. 1 is a perspective view of a conventional drum of thr prior art.
Figure 1A:
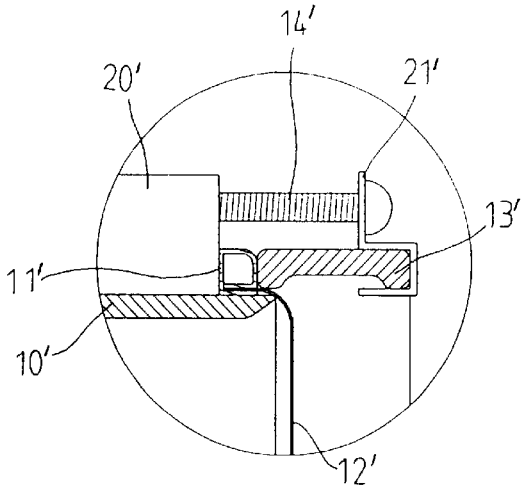
F I G. 1A PRIOR ART
FIG. 1A is a sectional view taken along circle A in FIG. 1.
Figure 2:
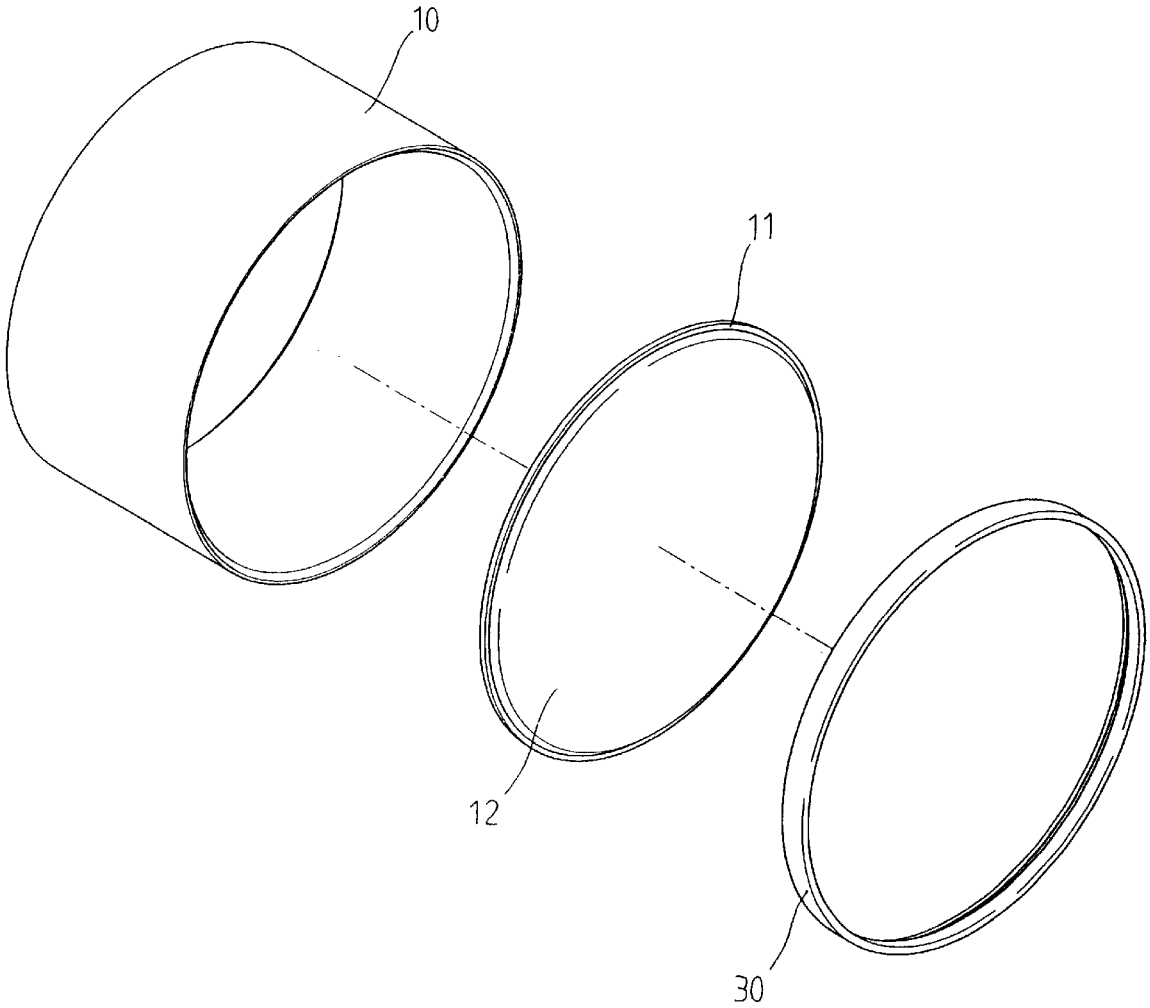
FIG. 2 is a perspective exploded view of a shell, a collar and a positioning hoop of a preferred embodiment in accordance with the present invention.
Figure 3:
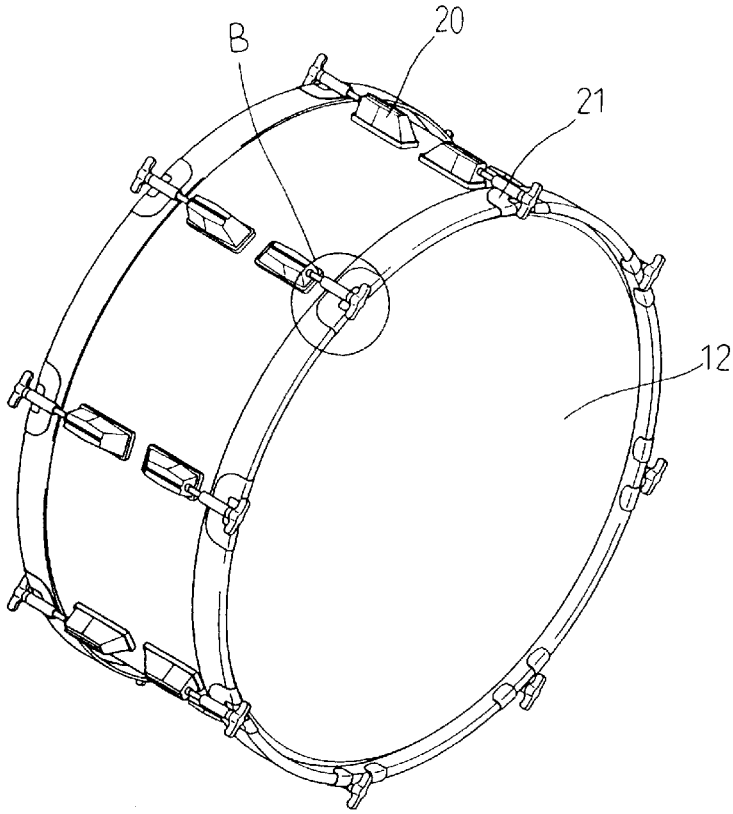
FIG. 3 is a perspective assembly view of a drum of a preferred embodiment in accordance with the present invention.
Figure 3A:
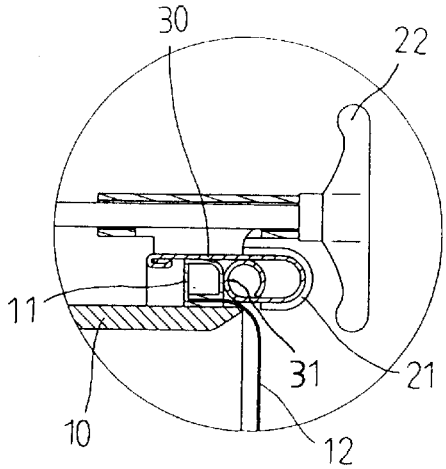
FIG. 3A is a sectional view taken along circle B in FIG. 3.

Referring to FIGS. 2, 3 and 3A, a drum comprises a shell 10, a pair of batter heads 12 disposed on two sides of the shell 10, a pair of collars 11 enclosing the batter heads 12 and surrounding the shell 10, a pair of positioning hoops 30 surrounding the collars 11, a large number of connection seats 20 disposed on the shell 10, a large number of positioning mounts 21 disposed on the positioning hoops 30, and a large number of positioning fasteners 22 fastening the connection seats 20 and the positioning mounts 21 together.

Each of the positioning hoops 30 has an inner curved flange 31 to press the corresponding collar 11 on the shell 10.

The invention is not limited to the above embodiment but various modification thereof may be made. Further, various changes in form and detail may be made without departing from the scope of the invention.

I claim:

1. A drum comprises:

a shell, a pair of batter heads mounted on two sides of the shell, a pair of collars enclosing the batter heads and surrounding the shell, a pair of positioning hoops surrounding a corresponding one of the collars, a plurality of connection seats mounted on the shell, a plurality of positioning mounts mounted on the positioning hoops, and a plurality of positioning fasteners fastening the connection seats and the positioning mounts together, and each of the positioning hoops having an inner curved flange urged on a periphery of the corresponding collar to press the corresponding collar on the shell.

* * * * *